US009566693B2

(12) United States Patent
Atkinson et al.

(10) Patent No.: US 9,566,693 B2
(45) Date of Patent: Feb. 14, 2017

(54) TURNBUCKLE WRENCH ASSEMBLY

(71) Applicant: The Boeing Company, Chicago, IL (US)

(72) Inventors: Grant J. Atkinson, Seattle, WA (US); Garry A. Goebel, Kent, WA (US); Richard D. Freeman, Burien, WA (US)

(73) Assignee: The Boeing Company, Chicago, IL (US)

( * ) Notice: Subject to any disclaimer, the term of this patent is extended or adjusted under 35 U.S.C. 154(b) by 276 days.

(21) Appl. No.: 14/283,635

(22) Filed: May 21, 2014

(65) Prior Publication Data

US 2015/0336244 A1 Nov. 26, 2015

(51) Int. Cl.
*B25B 13/48* (2006.01)
*B25B 13/08* (2006.01)
*B25B 13/04* (2006.01)

(52) U.S. Cl.
CPC ..... *B25B 13/481* (2013.01); *B25B 13/04* (2013.01); *B25B 13/08* (2013.01); *B25B 13/48* (2013.01)

(58) Field of Classification Search
CPC ..... B25B 13/04; B25B 13/08; B25B 13/48
USPC ..... 81/119
See application file for complete search history.

(56) References Cited

U.S. PATENT DOCUMENTS 1,522,083 A * 1/1925 Stensrud ..... B21D 11/14 72/385
1,525,213 A * 2/1925 Tietze ..... B25B 13/48 81/119
1,787,185 A * 12/1930 Baird ..... B25B 13/08 16/422
2,358,555 A 9/1944 Blanchard
2,397,574 A 4/1946 Thonet
2,475,606 A 7/1949 Gagnon
2,518,088 A 8/1950 Spielman
3,772,943 A 11/1973 Itano
4,114,433 A 9/1978 Bowen
4,130,032 A * 12/1978 Giandomenico ..... B25B 13/02 81/119

(Continued)

FOREIGN PATENT DOCUMENTS

DE 3623187 12/1987
FR 2587263 3/1987
WO WO 9937447 7/1999

OTHER PUBLICATIONS

Extended European Search Report dated Oct. 5, 2015 from EP Application No. 15155415.1.

*Primary Examiner* — David B Thomas
(74) *Attorney, Agent, or Firm* — Baldauff IP, LLC; Michael J. Baldauff, Jr.

(57) ABSTRACT

A wrench assembly for turning a central portion of a turnbuckle. The wrench assembly includes first and second wrenches that are substantially identical. Slots in body portions of each of the wrenches define open ends that are oppositely disposed to one another when engaging the central portion of the turnbuckle. The wrenches may be detachably secured together around the central portion of the turnbuckle. At least two spokes extend outwardly from a periphery of each of the body portions of the wrenches that are utilized to impart rotational movement to the central portion of the turnbuckle. In at least one configuration, a distal end of an elongated member is used to push and pull on the spokes to impart the rotational movement.

15 Claims, 9 Drawing Sheets

(56) References Cited

U.S. PATENT DOCUMENTS

| | | | | |
|---|---|---|---|---|
| 5,546,833 | A * | 8/1996 | Holdeman | E21B 19/167 81/52 |
| 5,562,006 | A * | 10/1996 | Pelosi, Jr. | B25B 13/00 81/119 |
| 5,673,976 | A * | 10/1997 | Hillis | B25B 13/48 301/58 |
| 5,931,063 | A * | 8/1999 | Kuo | B25B 13/08 81/119 |
| 6,112,625 | A | 9/2000 | Turtle | |
| 6,912,936 | B2 * | 7/2005 | Hume | B25B 13/48 81/119 |
| 7,628,212 | B2 * | 12/2009 | Tjader | B25B 13/488 166/380 |
| 8,353,229 | B1 * | 1/2013 | Muhareb | B25B 13/08 81/55 |
| 8,539,864 | B1 | 9/2013 | Kennedy | |
| 8,561,504 | B2 * | 10/2013 | Buchanan | B25B 13/04 81/121.1 |
| 8,789,445 | B1 * | 7/2014 | Hawley, III | B25B 21/002 81/119 |
| 2008/0128172 | A1 * | 6/2008 | Tjader | B25B 13/488 175/85 |
| 2008/0272590 | A1 | 11/2008 | Howard et al. | |
| 2010/0044112 | A1 * | 2/2010 | Tjader | B25B 13/488 175/320 |
| 2012/0297937 | A1 | 11/2012 | Evans | |
| 2013/0213191 | A1 | 8/2013 | Harvey et al. | |
| 2014/0033880 | A1 * | 2/2014 | Hill | B25B 13/04 81/121.1 |

* cited by examiner

TURNBUCKLE WRENCH ASSEMBLY

TECHNICAL FIELD

The field of the embodiments presented herein relate to a wrench assembly for adjusting tension created by rotating a turnbuckle and, in particular, to rotating turnbuckles in a test assembly from a safe distance.

BACKGROUND

Some structural test assemblies use a large number of turnbuckles. These turnbuckles require adjustment while a test article such as a panel is under load. This presents a safety hazard. Typically the test operators adjust the turnbuckles by climbing into the test frame or reaching into the test frame with their hands while the article is under load. These loads can sometimes be 100,000 lbs. or more. The turnbuckles within the test assembly also create ergonomic difficulties. Because of the configuration of the test assembly and the large number of turnbuckles in a confined space, it is difficult to satisfactorily adjust each of the turnbuckles.

It is with respect to these and other considerations that the disclosure herein is presented.

SUMMARY

It should be appreciated that this Summary is provided to introduce a selection of concepts in a simplified form that are further described below in the Detailed Description. This Summary is not intended to be used to limit the scope of the claimed subject matter.

According to one embodiment disclosed herein, a wrench assembly for turning a central portion of a turnbuckle about a rotational axis is provided. The wrench assembly includes a first wrench having a first body portion and a second wrench having a second body portion. The first and second body portions each include a slot defining an open end. The open ends of the first and second body portions are oppositely disposed to one another about the central portion of the turnbuckle. The slots are at least partially adjacent one another along the rotational axis of the central portion and simultaneously engage the central portion of the turnbuckle for the first and second wrenches to turn the central portion of the turnbuckle about the rotational axis. At least two spokes extend outwardly from around a periphery of the first body portion and at least two spokes extend outwardly from around a periphery of the second body portion. The spokes of the first body portion and the spokes of the second body portion are equally spaced from one another.

According to another embodiment disclosed herein, a wrench assembly for turning a central portion of a turnbuckle about a rotational axis is provided. The wrench assembly includes a first wrench having a first body portion and a second wrench having a second body portion. The first and second body portions are substantially identical to one another with each comprising a slot defining an open end. The open ends of the first and second body portions are oppositely disposed to one another to encircle the central portion of the turnbuckle. The slots are at least partially adjacent one another along the rotational axis of the central portion and simultaneously engage the central portion of the turnbuckle for the first and second wrenches to turn the central portion of the turnbuckle about the rotational axis. At least two spokes extend outwardly from around a periphery of the first body portion and at least two spokes extended outwardly from around a periphery of the second body portion. The spokes of the first body portion and the spokes of the second body portion are equally spaced from one another.

According to yet another embodiment disclosed herein, a method for turning a central portion of a turnbuckle about a rotational axis is provided. The method includes providing a first wrench including a first body portion and a second wrench including a second body portion, the first and second body portions each including a slot defining an open end and at least two spokes extending outward from a periphery of each of the first and second body portions. The method also includes oppositely disposing the open ends to one another about the central portion of the turnbuckle and simultaneously engaging the central portion of the turnbuckle with the slots at least partially adjacent one another along the rotational axis of the central portion. The method also includes imparting rotational movement of the central portion of the turnbuckle about the rotational axis through one of the spokes of one of the first and second wrenches. The method may also include aligning an opening in the first body portion with an opening in the second body portion and detachably securing the first and second wrenches together.

The features, functions, and advantages that have been discussed can be achieved independently in various embodiments of the present disclosure or may be combined in yet other embodiments, further details of which can be seen with reference to the following description and drawings.

BRIEF DESCRIPTION OF THE DRAWINGS

The embodiments presented herein will become more fully understood from the detailed description and the accompanying drawings, wherein.

The plurality of figures presented in this application illustrates variations and different aspects of the embodiments of the present disclosure. Accordingly, the detailed description on each illustration will describe the differences identified in the corresponding illustration.

DETAILED DESCRIPTION

The following detailed description is directed to testing of articles used in the manufacture of vehicle and testing the articles in structural test assemblies. In particular, the following detailed description is directed to a wrench assembly for adjusting tension of turnbuckles within the test assembly from a safe distance. The present disclosure is susceptible of embodiment in many different forms.

Aspects of this disclosure may be used with many types of turnbuckles and in many types of structural test assemblies. The articles may be similar to those which are used to form part of a vehicle such as, for example, a panel for an aircraft, spacecraft, satellite, watercraft, submarine, and passenger, agricultural or construction vehicles. For the sake of simplicity in explaining aspects of the present disclosure, this specification will proceed utilizing a turnbuckle 10 as the primary example. However, many of aspects of the present disclosure are not limited to the turnbuckle 10.

Figure 1:
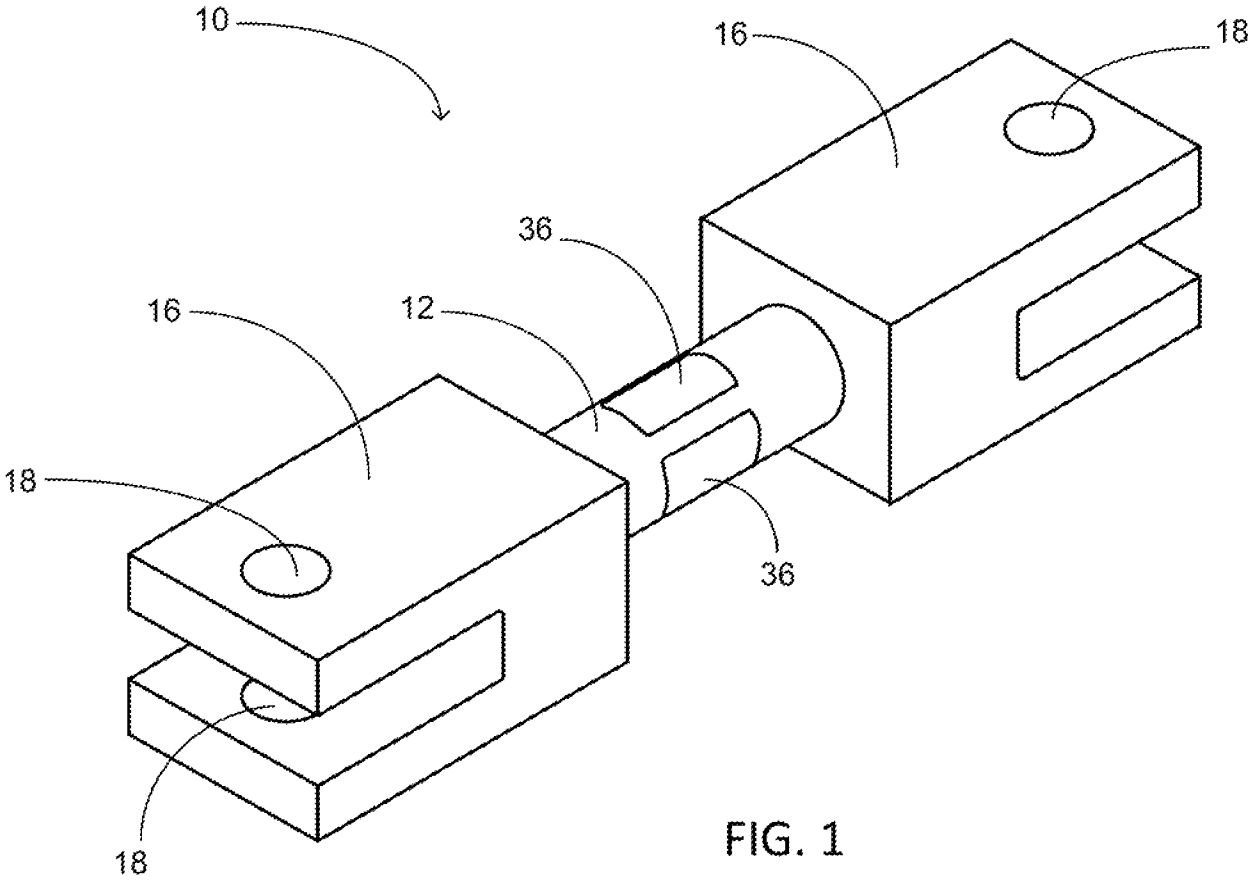
FIG. 1 illustrates a perspective view of a turnbuckle according to at least one embodiment disclosed herein.
Figure 2:
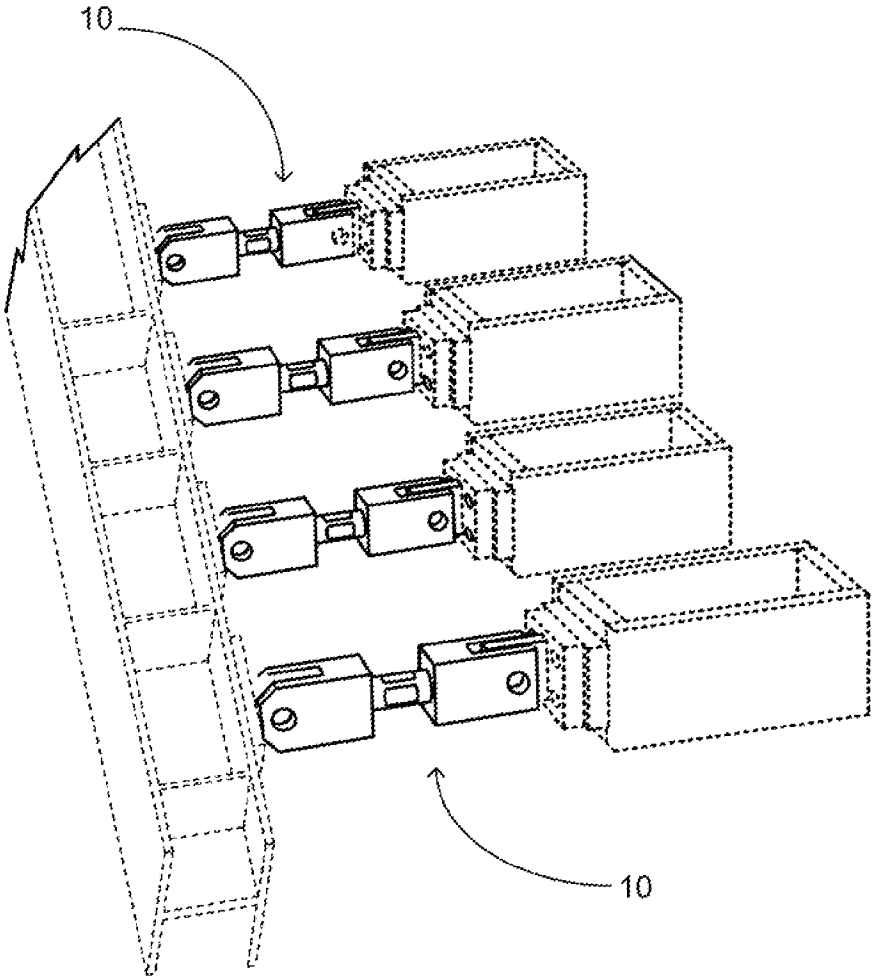
FIG. 2 illustrates a perspective view of a plurality of turnbuckles in a test assembly configured for testing an article such as a panel of an aircraft according to at least one embodiment disclosed herein.

Referring now to the drawings, in which like numerals represent like elements throughout the several figures, aspects of the present disclosure will be presented. FIG. 1 illustrates a perspective view of the turnbuckle 10. The turnbuckle 10 includes a central portion 12 in the form of a cylindrical rod which has opposite threaded ends which are familiar to those skilled in the art. On each end of the central portion 12 is a fastener such as a clevis 16. The clevis 16 is u-shaped and has holes 18 at the end of prongs to accept a clevis pin (not shown). A lug may be received between the prongs and the clevis pin placed through the lug to attach the turnbuckle 10 to the test assembly. FIG. 2 illustrates a perspective view of a plurality of turnbuckles 10 in a portion of a structural test assembly shown in phantom.

Figure 3:
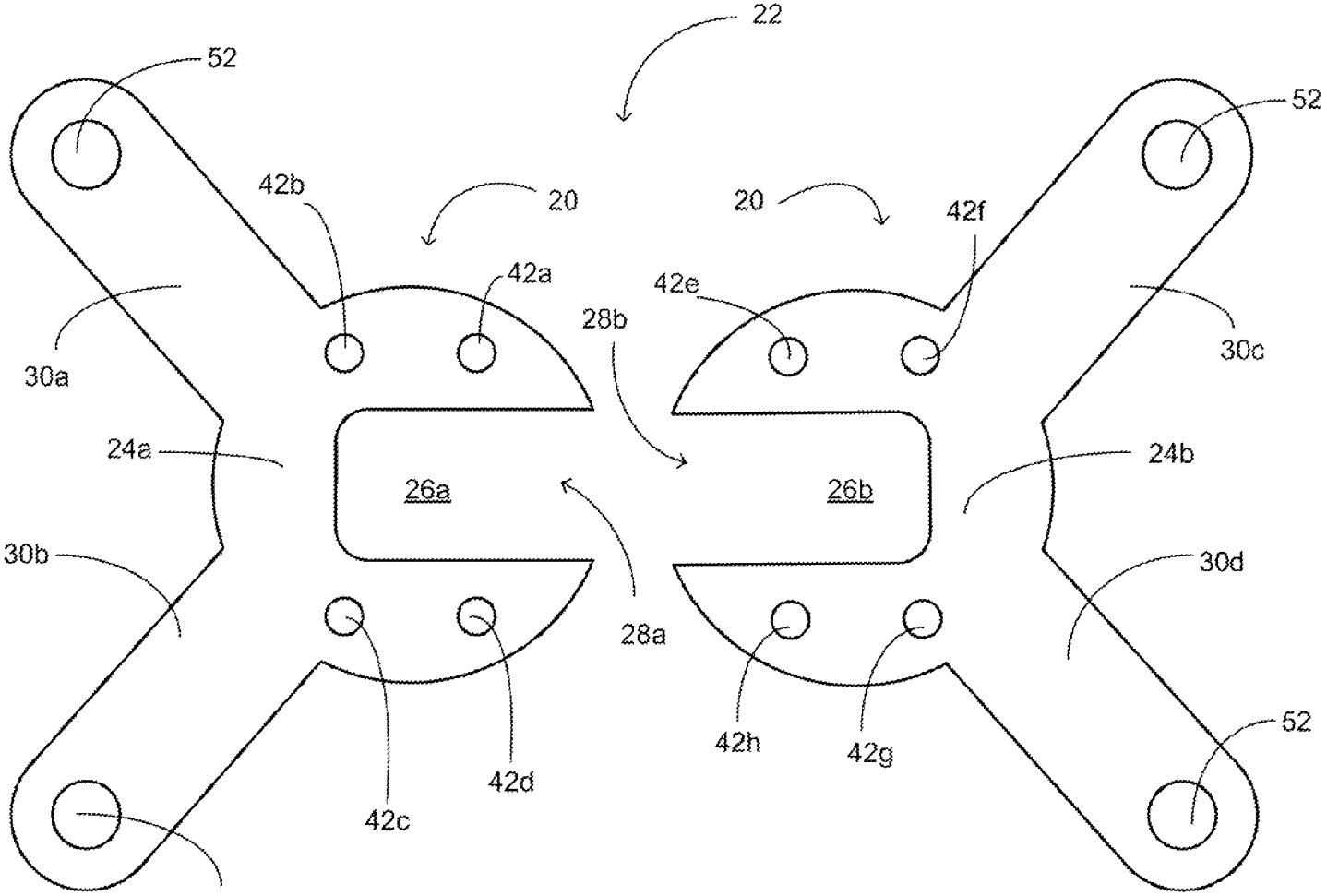
FIG. 3 illustrates a front view of a pair of oppositely disposed multi-spoked wrenches of a wrench assembly according to at least one embodiment disclosed herein.
Figure 4:
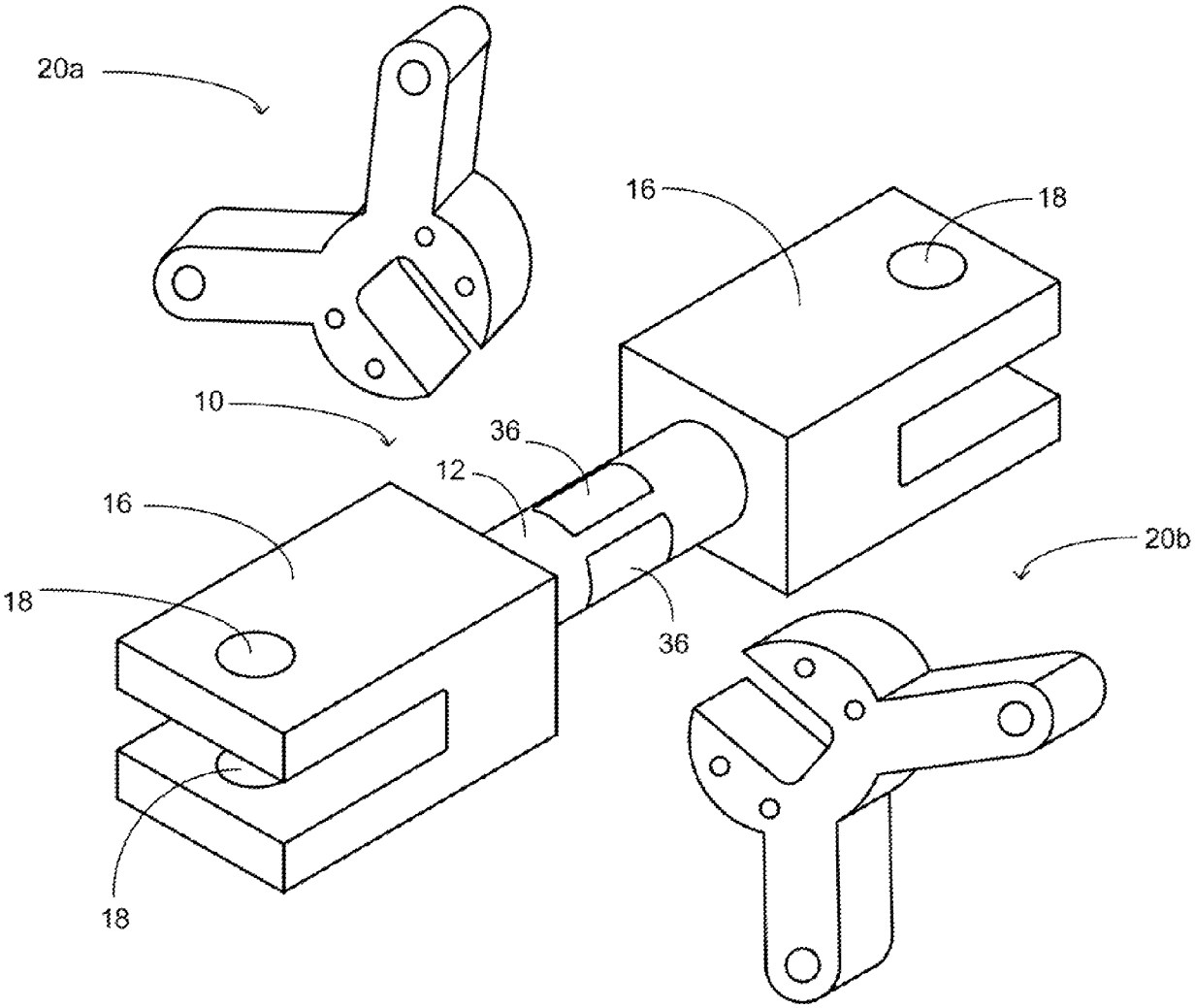
FIG. 4 illustrates a perspective view of the two multi-spoked wrenches of the wrench assembly about to be placed on the turnbuckle of FIG. 1 according to at least one embodiment disclosed herein.

FIG. 3 illustrates a front view of first and second wrenches 20*a*, 20*b* (hereinafter may be referred to collectively and/or generically as "wrench 20" or "wrenches 20"). For the sake of simplicity in explaining aspects of the present disclosure, one or more other like elements may be referenced by like numbers followed by different letters but then may also be referred to collectively and/or generically by the like numbers without the letters. The pair of wrenches 20*a*, 20*b* at least partially define a wrench assembly 22 (FIG. 4). The wrenches 20*a*, 20*b* are preferably substantially identical and are formed from a metallic flat plate-like structure having first and second body portions 24*a*, 24*b*. The body portions 24*a*, 24*b* include first and second slots 26*a*, 26*b* that define open ends 28*a*, 28*b* of each of the wrenches 20*a*, 20*b*. Each wrench 20*a*, 20*b* is a multi-spoked wrench in that each of the wrenches 20*a*, 20*b* also includes at least two spokes 30 that extend outward from around the periphery of the body portions 24*a*, 24*b*. As shown in FIG. 3, first wrench 20*a* includes spokes 30*a* and 30*b* and second wrench 20*b* includes spokes 30*c* and 30*d*. Each of the spokes 30*a*, 30*b* of the first wrench 20*a* and each of the spokes 30*c*, 30*d* of the second wrench 20*b* allow a test operator to manually apply a force to the first wrench 20*a* and to the second wrench 20*b*, respectively. Adjustment of the position of the turnbuckle 10 via the spokes 30 requires less force than manually adjusting the turnbuckle 10 does due to the mechanical advantage provided by each of the spokes 30.

FIG. 4 illustrates a perspective view of the turnbuckle 10 and the two wrenches 20*a*, 20*b* about to be placed on the central portion 12 of the turnbuckle 10. The central portion 12 of the turnbuckle 10 includes a plurality of flat portions 36 on an exterior surface of the central portion 12. The flat portions 36 are preferably equally spaced apart from one another around the circumference of the central portion 12 and have a length along a rotational axis of the central portion 12 that is at least long enough to accommodate the widths of the first and second wrenches 20*a*, 20*b* when the first and second wrenches 20*a*, 20*b* are placed alongside one another in a parallel manner. Each of the slots 26*a*, 26*b* of the first and second body portions 24*a*, 24*b* are sized and cooperate with one another to encircle the central portion 12 and engage at least a pair of the flat portions 36 for rotating the central portion 12 of the turnbuckle 10 with the wrench assembly 22. Preferably, the slot 26*a* of the first wrench 20*a* engages a flat portion 36 opposite another flat portion 36 engaged by the slot 26*b* of the second wrench 20*b*. In other words, the first and second wrenches 20*a*, 20*b* are placed approximately 180 degrees from each other on the axis of the central portion 12.

Figure 5:
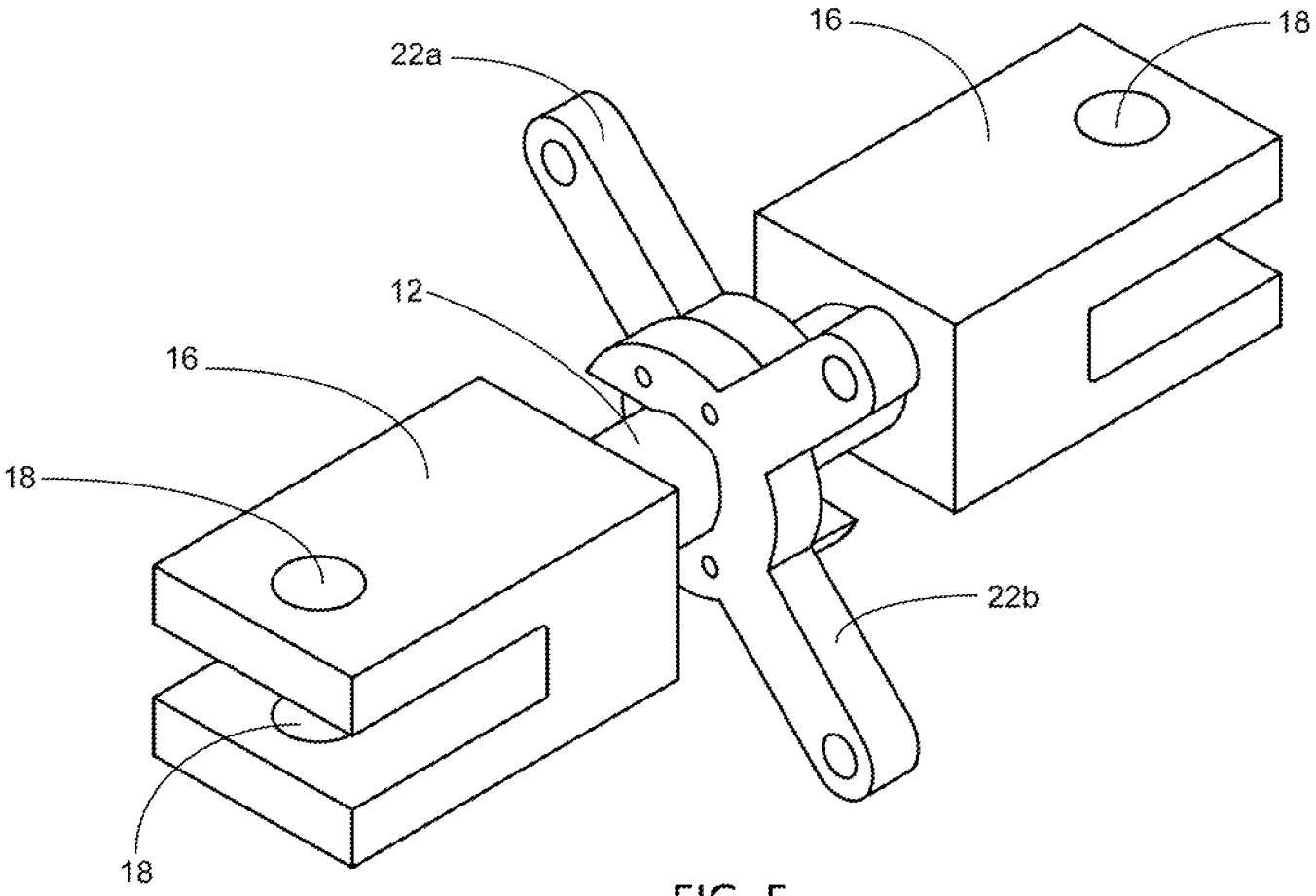
FIG. 5 illustrates the wrench assembly placed onto the central portion of the turnbuckle according to at least one embodiment disclosed herein.

FIG. 5 illustrates the wrench assembly 22 placed onto the central portion 12 of the turnbuckle 10. The open ends 28*a*, 28*b* of the first wrench 20*a* and the second wrench 20*b* are oppositely disposed to another about the central portion 12 of the turnbuckle 10 and the slots 26*a*, 26*b* are at least partially adjacent one another along the rotational axis of the central portion 12. The slots 26*a*, 26*b* also simultaneously engage the central portion 12 of the turnbuckle 10 for the first and second wrench 20*a*, 20*b* to turn the central portion 12 of the turnbuckle 10 about its rotational axis.

Figure 6:
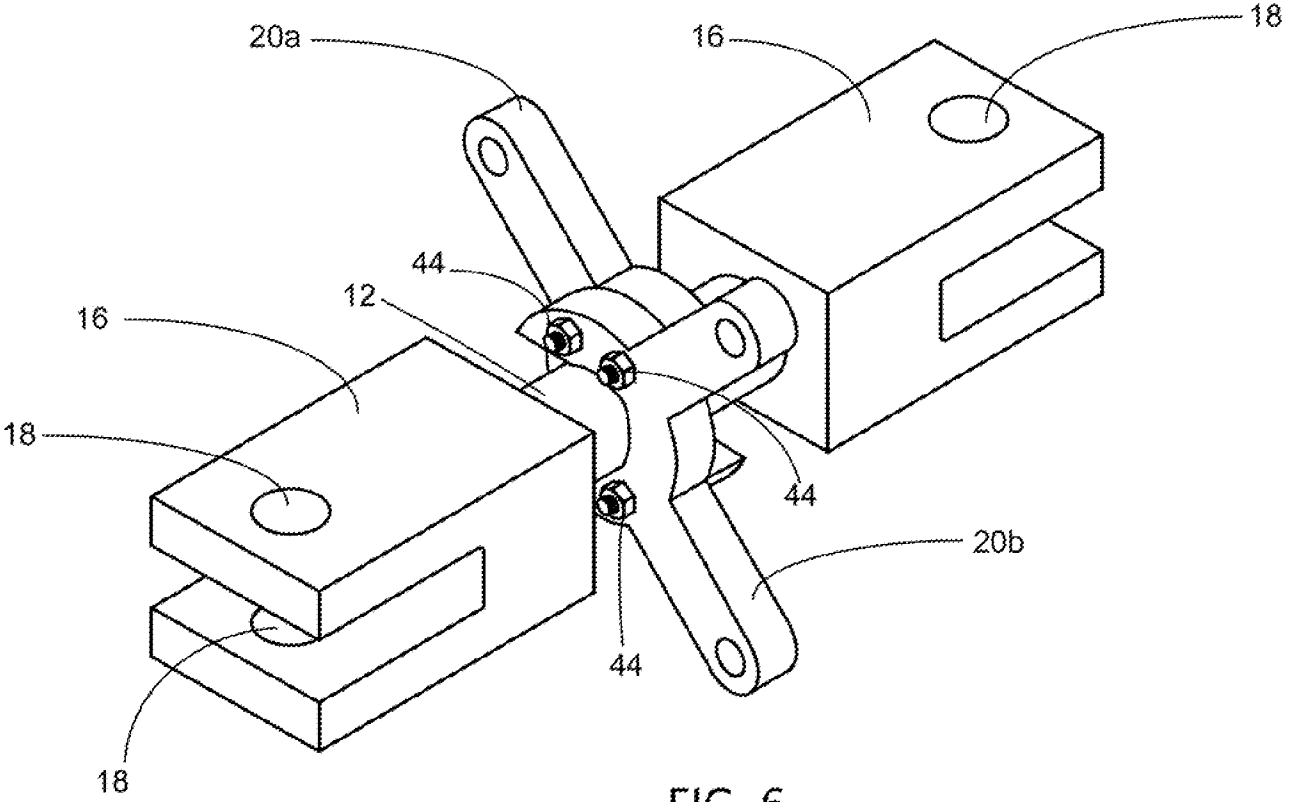
FIG. 6 illustrates the two multi-spoked wrenches of the wrench assembly secured together about the central portion of the turnbuckle with fasteners according to at least one embodiment disclosed herein.

Referring back to FIG. 3, each of the wrenches 20*a*, 20*b* includes at least one opening 42 therethrough. Preferably, the first wrench 20*a* includes openings 42*a*, 42*b*, 42*c* and 42*d*, therethrough, and the second wrench 20*b* includes openings 42*e*, 42*f*, 42*g* and 42*h*, therethrough. Each one of the openings 42 of the first wrench 20*a* is aligned with a corresponding one of the openings 42 of the second wrench 20*b* when the open ends 28*a*, 28*b* of the first and second body portions 24*a*, 24*b* are oppositely disposed to one another and the slots 26*a*, 26*b* are at least partially adjacent one another for engaging the central portion 12. In at least one configuration, for example, the openings 42*a*, 42*b*, 42*c*, 42*d* are aligned with the openings 42*e*, 42*f*, 42*g*, 42*h*, respectively. The openings 42 of the first and second wrenches 20*a*, 20*b* are aligned with one another so that mechanical fasteners 44 may detachably secure the first and second wrenches 20*a*, 20*b* together around the central portion 12 of the turnbuckle. FIG. 6 illustrates the two wrenches 20 of the wrench assembly 22 secured together about the central portion 12 of the turnbuckle 10 with fasteners 44.

Figure 7:
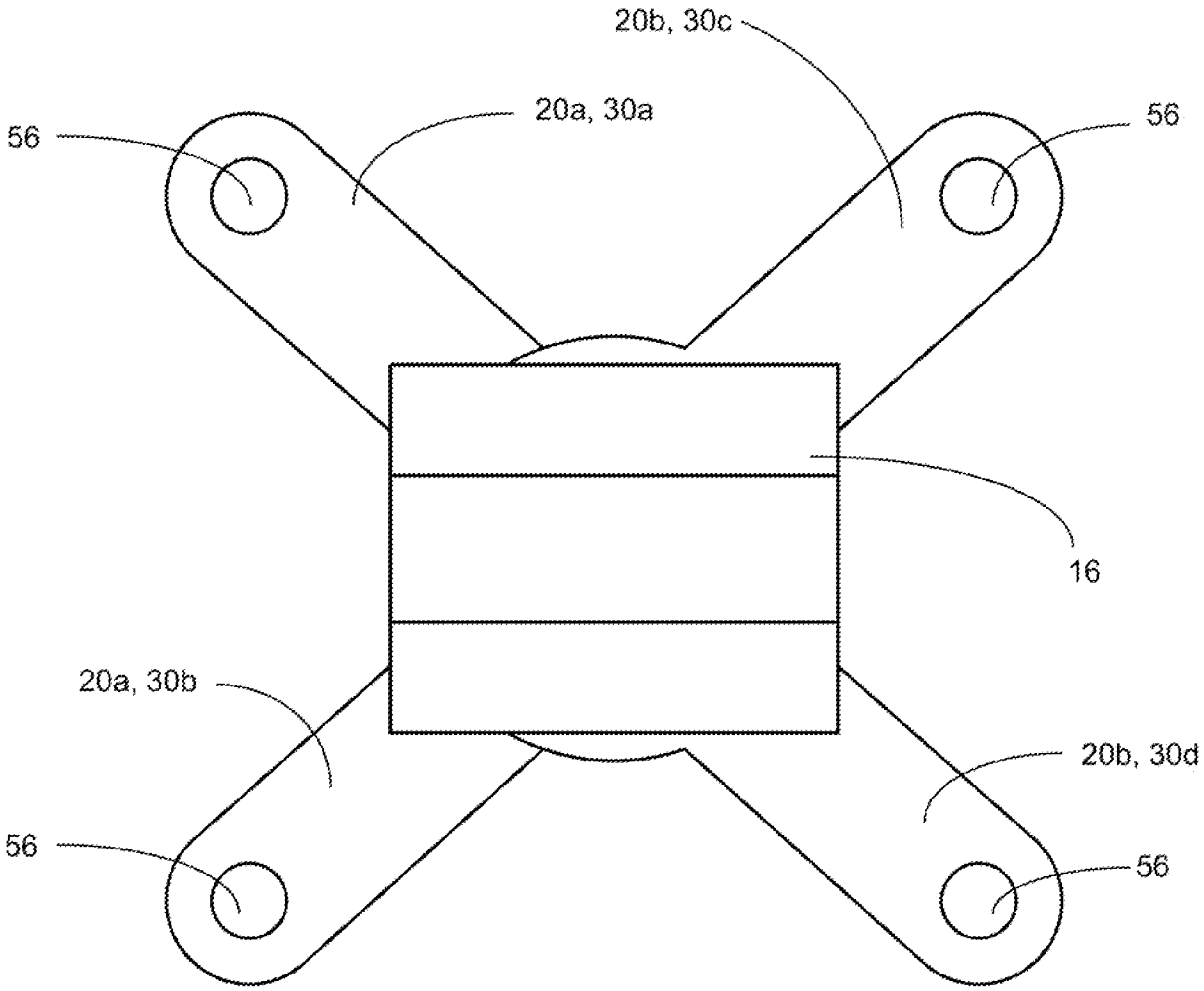
FIG. 7 illustrates an end view of the wrench assembly on the central portion of the turnbuckle according to at least one embodiment disclosed herein.

FIG. 7 illustrates an end view of the wrench assembly 22 on the central portion 12 of the turnbuckle 10 according to at least one configuration. Each of the wrenches 20*a*, 20*b* preferably have an equal number of spokes 30 so that when the wrenches 20*a*, 20*b* are opposite one another on the central portion 12 of the turnbuckle 10 they are substantially symmetrical and so that all the spokes 30 are equally spaced from one another about the peripheries of the first and second body portions 24*a*, 24*b*. The wrench assembly is sometimes referred to as a "helm" because it appears similar to a ship's helm from the end view. Preferably, at least one of the spokes 30 is always accessible within the structural test assembly for turning the central portion 12. In at least one configuration, each of the spokes 30 are approximately ninety degrees apart from one another.

Figure 8:
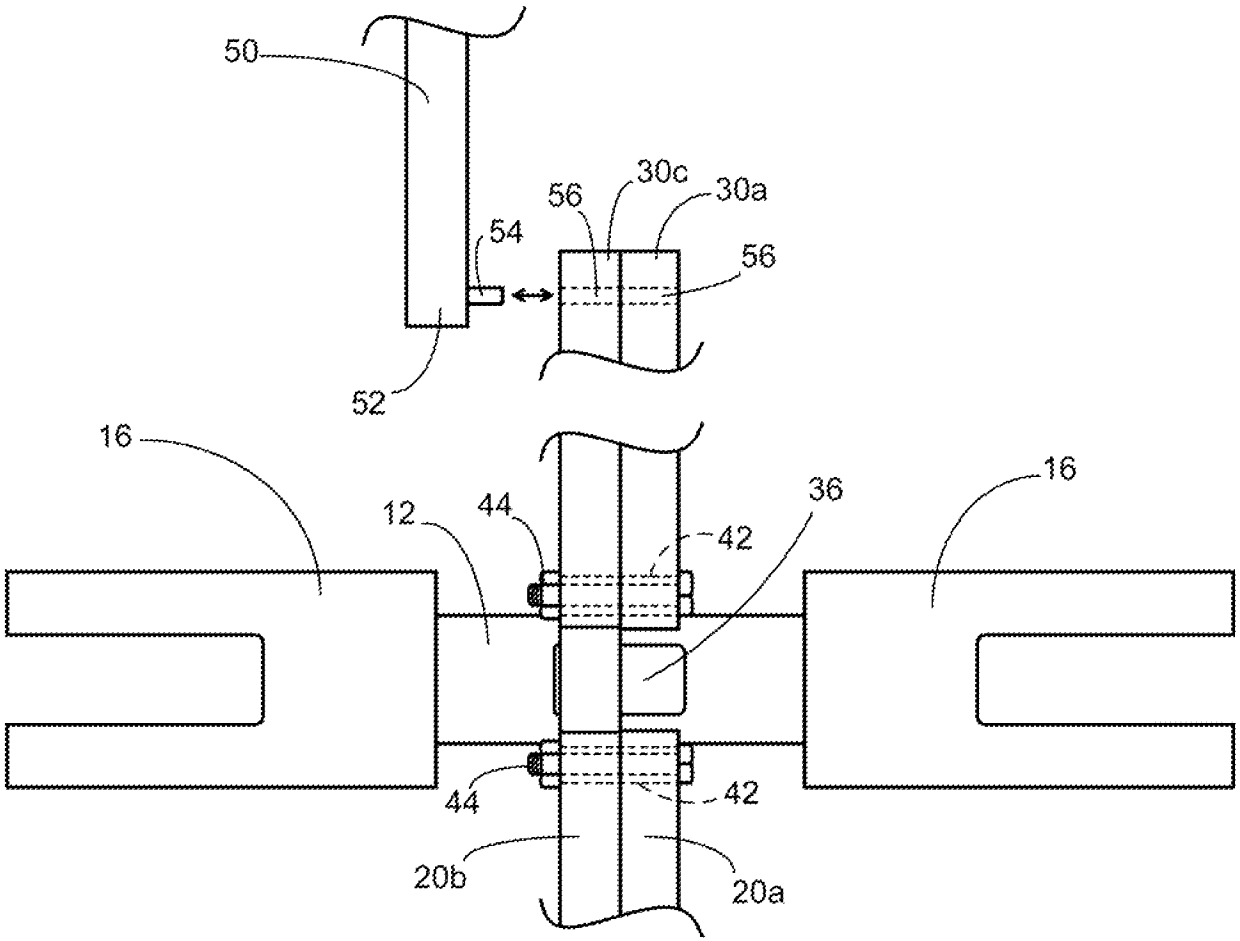
FIG. 8 illustrates a partial front view of the wrench assembly on the central portion of the turnbuckle and an elongated member configured to push or pull one of the spokes of the wrench assembly to adjust the turnbuckle according to at least one embodiment disclosed herein.

FIG. 8 illustrates a partial front view of the wrench assembly 22 on the central portion 12 of the turnbuckle 10 and an elongated member 50 configured to push or pull one of the spokes 30 of the wrench assembly 22 to adjust the turnbuckle 10. The structural test assemblies under load present a safety hazard to test operators. Large test assemblies require long reaches in confined spaces in order to access the turnbuckles 10. The elongated member 50 is preferably long enough to eliminate the need for the test operators to reach into the test assembly while under load and long enough to reach all of the turnbuckles 10. The elongated member 50 is also preferably made of a suitable material that is rigid enough to impart rotational movement of the central portion 12 of the turnbuckle 10 through the spokes 30 by pushing and pulling on the spokes 30. In at least one configuration, a distal end 52 of the elongated member 50 includes a pin 54 that is received in an opening 56 on the distal ends of the each of the spokes 30. With the pin 54 received in one of the openings 56 in one of the spokes 30, the test operator more easily can push and pull on the spoke 30 to impart rotation upon the central portion 12 of the turnbuckle 10. Still referring to FIG. 8, for example, the pin 54 may be received and removed from the openings 56 of the spoke 30*c*. Because of the particular view depicted in FIG. 8, the openings 56 of spokes 30*a* and 30*c* appear to be aligned with one another for the pin 54, but the openings 56 of spokes 30*a* and 30*b* are in fact not aligned with one another as best shown in FIG. 7.

Figure 9:
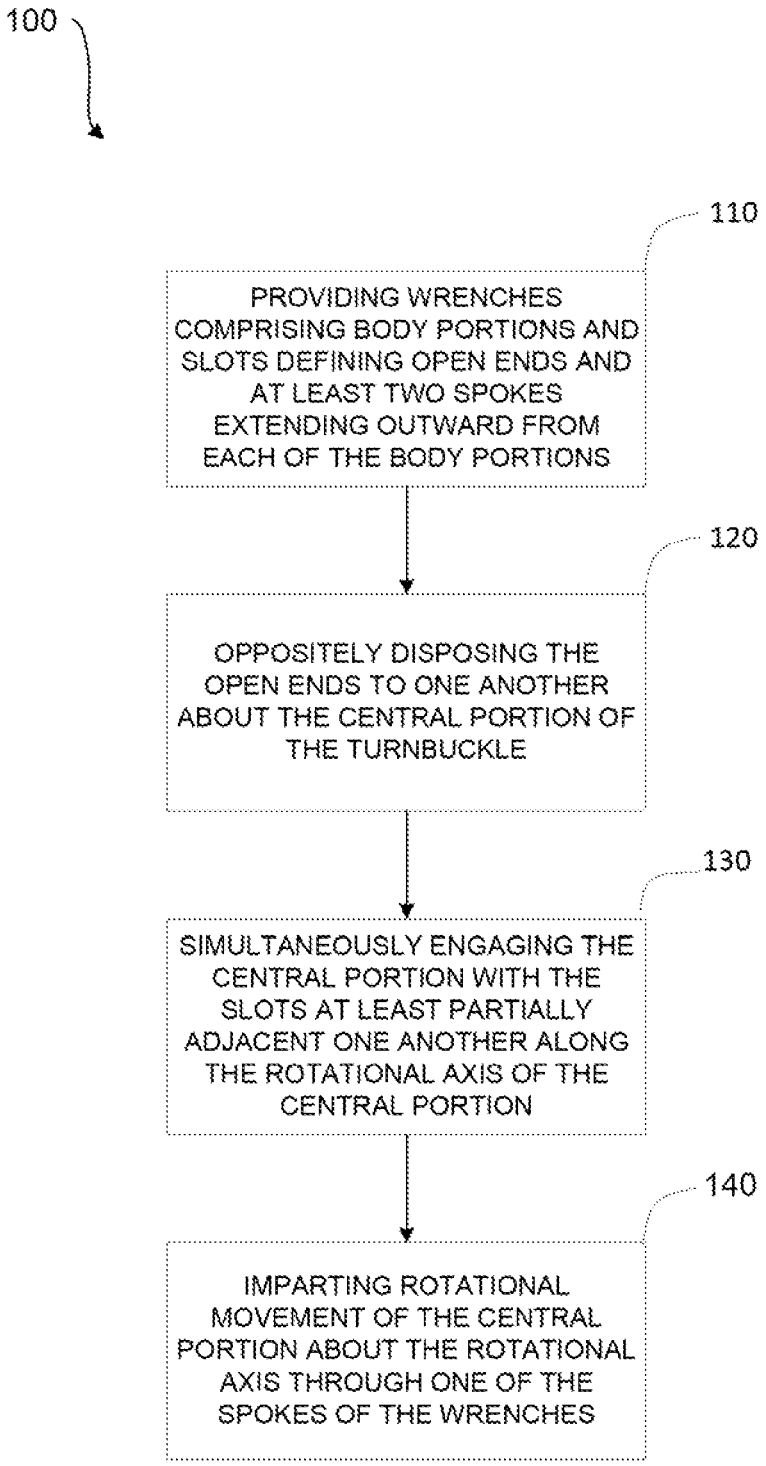
FIG. 9 illustrates one configuration of a method for turning a central portion of a turnbuckle according to at least one embodiment disclosed herein.

FIG. 9 illustrates a method 100 for turning the central portion 12 of the turnbuckle 10 about a rotational axis. Unless otherwise indicated, more or fewer operations may be performed than shown in the figures and described herein. Additionally, unless otherwise indicated, these operations may also be performed in a different order than those described herein.

The method 100 starts at operation 110 with providing a first wrench 20*a* having a first body portion 24*a* and a second wrench 20*b* having a second body portion 24*b*, the first and second body portions 24*a*, 24*b* each include a slot 26 defining an open end 28 and at least two spokes 30 extending outward from a periphery of each of the first and second body portions 24*a*, 24*b*. Next, the method 100 includes operation 120 of oppositely disposing the open ends 28 to one another about the central portion 12 of the turnbuckle 10. Operation 130 includes simultaneously engaging the central portion 12 of the turnbuckle 10 with the slots 26 at least partially adjacent one another along the rotational axis of the central portion 12 and operation 140 includes imparting rotational movement of the central portion 12 of the turnbuckle 10 about the rotational axis through one of the spokes 30 of one of the first and second wrenches 20*a*, 20*b*.

Operation 140 of imparting rotational movement may include pushing or pulling on the spokes 30 that are equally spaced apart and that extend from the periphery of each of the first and second body portions 24*a*, 24*b* of the first and second wrenches 20*a*, 20*b*. For example, imparting rotational movement to the central portion 12 of the turnbuckle 10 may be performed by pushing or pulling on one of the spokes 30 with the distal end 52 of an elongated member 50. It should be noted that while imparting the rotational movement to the central portion 12 of the turnbuckle 10 with the elongated member 50, the test article attached to the turnbuckle 10 may be under significant load, perhaps to the magnitude of 100,000 pounds or more. By utilizing the elongated member 50 in combination with the spokes 30 of the first and second wrenches 20*a*, 20*b*, the operator may safely adjust the turnbuckles from a position outside of the test assembly.

Method 100 may also include the operation of aligning an opening 42 in the first body portion 24*a* with an opening 42 in the second body portion 24*b*. The method 100 may also include detachably securing the first and second wrenches 20*a*, 20*b* together.

The subject matter described above is provided by way of illustration only and should not be construed as limiting. Various modifications and changes may be made to the subject matter described herein without following the example embodiments and applications illustrated and described, and without departing from the true spirit and scope of the present disclosure, which is set forth in the following claims.

What is claimed is:

1. A wrench assembly for turning a central portion of a turnbuckle about a rotational axis, the wrench assembly comprising:

a first wrench comprising a first body portion and at least two spokes extending outwardly from around a periphery of the first body portion; and a second wrench comprising a second body portion and at least two spokes extending outwardly from around a periphery of the second body portion, the first and second body portions each comprising a slot defining an open end, the open ends of the first and second body portions oppositely disposed to one another about the central portion of the turnbuckle, and the slots at least partially adjacent one another along the rotational axis of the central portion and simultaneously engaging the central portion of the turnbuckle for the first and second wrenches to turn the central portion of the turnbuckle about the rotational axis, wherein the at least two spokes of the first body portion and the at least two spokes of the second body portion are equally spaced from one another and distal ends of each of the at least two spokes of the first and second body portion includes an opening therethrough for interfacing with an end of an elongated member, the elongated member configured to impart rotational movement of the central portion of the turnbuckle through one of the spokes of one of the first and second wrenches.

2. The wrench assembly of claim 1, wherein the first wrench further comprises two spokes extending outwardly from around a periphery of the first body portion and the second wrench further comprises two spokes extending outwardly from around a periphery of the second body portion, and wherein each of the two spokes of the first body portion and each of the two spokes of the second body portion are approximately 90 degrees apart from one another.

3. The wrench assembly of claim 1, wherein the first wrench and the second wrench are substantially identical to one another.

4. The wrench assembly of claim 1, wherein the first wrench and the second wrench cooperate to encircle the central portion of the turnbuckle.

5. The wrench assembly of claim 1, wherein the first and second wrenches are detachably secured to one another.

6. A wrench assembly for turning a central portion of a turnbuckle about a rotational axis, the wrench assembly comprising:

a first wrench comprising a first body portion; and a second wrench comprising a second body portion, the first and second body portions each comprising a slot defining an open end, the open ends of the first and second body portions oppositely disposed to one another about the central portion of the turnbuckle, and the slots at least partially adjacent one another along the rotational axis of the central portion and simultaneously engaging the central portion of the turnbuckle for the first and second wrenches to turn the central portion of the turnbuckle about the rotational axis, wherein the first body portion further comprises an opening therethrough and the second body portion further comprises at an opening therethrough, and wherein the opening of the first body portion aligns with the opening of the second body portion when the open ends of the first and second body portions are oppositely disposed to one another about the central portion of the turnbuckle and when the slots are at least partially adjacent one another and engaging the central portion of the turnbuckle.

7. The wrench assembly of claim 6, wherein the openings of the first and second body portions are aligned with one another and further comprising a fastener configured to be received in the openings of the first and second body portions when aligned to detachably secure the first and second wrenches to one another about the central portion of the turnbuckle.

8. The wrench assembly of claim 6, wherein the central portion of the turnbuckle comprises a plurality of flat portions, and wherein the slots of the first and second body portions engage with the flat portions for rotating the central portion of the turnbuckle with the wrench assembly.

9. A wrench assembly for turning a central portion of a turnbuckle about a rotational axis, the wrench assembly comprising:

a first wrench comprising a first body portion;

a second wrench comprising a second body portion, the first and second body portions substantially identical to one another and each comprising a slot defining an open end, the open ends of the first and second body portions oppositely disposed to one another to encircle the central portion of the turnbuckle, and the slots at least partially adjacent one another along the rotational axis of the central portion and simultaneously engaging the central portion of the turnbuckle for the first and second wrenches to turn the central portion of the turnbuckle about the rotational axis; and at least two spokes extending outwardly from around a periphery of the first body portion and at least two spokes extending outwardly from around a periphery of the second body portion, wherein the at least two spokes of the first body portion and the at least two spokes of the second body portion are equally spaced from one another and comprise openings through each of distal ends of the at least two spokes of the first and second body portions and an elongated member configured for interfacing with an end of an elongated member, the elongated member configured to impart rotational movement of the central portion of the turnbuckle through one of the spokes of one of the first and second wrenches.

10. The wrench assembly of claim 9, wherein the first and second wrenches are detachably secured to one another with at least one fastener.

11. The wrench assembly of claim 9, wherein the first body portion further comprises an opening therethrough and the second body portion further comprises at an opening therethrough, and wherein the opening of the first body portion aligns with the opening of the second body portion when the open ends of the first and second body portions are oppositely disposed to one another to encircle the central portion of the turnbuckle.

12. A method for turning a central portion of a turnbuckle about a rotational axis, the method comprising:

providing a first wrench comprising a first body portion and a second wrench comprising a second body portion, the first and second body portions each comprising a slot defining an open end and at least two spokes extending outward from a periphery of each of the first and second body portions;

oppositely disposing the open ends to one another about the central portion of the turnbuckle;

simultaneously engaging the central portion of the turnbuckle with the slots at least partially adjacent one another along the rotational axis of the central portion;

detachably securing the first and second wrenches together; and imparting rotational movement of the central portion of the turnbuckle about the rotational axis through one of the spokes of one of the first and second wrenches.

13. The method of claim 12 further comprising aligning an opening in the first body portion with an opening in the second body portion.

14. A method for turning a central portion of a turnbuckle about a rotational axis, the method comprising:

providing a first wrench comprising a first body portion and a second wrench comprising a second body portion, the first and second body portions each comprising a slot defining an open end and at least two spokes equally spaced apart and extending outward from a periphery of each of the first and second body portions;

oppositely disposing the open ends to one another about the central portion of the turnbuckle;

simultaneously engaging the central portion of the turnbuckle with the slots at least partially adjacent one another along the rotational axis of the central portion; and imparting rotational movement of the central portion of the turnbuckle about the rotational axis through one of the spokes of one of the first and second wrenches by pushing or pulling on one of the spokes with an end of an elongated member.

15. The method of claim 14 wherein imparting rotational movement of the central portion of the turnbuckle further comprises receiving the end of the elongated member in an opening in a distal end of the spoke.

* * * * *